US006608979B1

(12) United States Patent
Landa et al.

(10) Patent No.: US 6,608,979 B1
(45) Date of Patent: Aug. 19, 2003

(54) CHARGER FOR A PHOTORECEPTOR

(75) Inventors: Benzion Landa, Nes-Ziona (IL); Josef Rosen, Moshav-Sitriya (IL)

(73) Assignee: Indigo N.V., Maastricht (NL)

( * ) Notice: Subject to any disclaimer, the term of this patent is extended or adjusted under 35 U.S.C. 154(b) by 0 days.

(21) Appl. No.: 09/700,986

(22) PCT Filed: May 24, 1998

(86) PCT No.: PCT/IL98/00235

§ 371 (c)(1),
(2), (4) Date: Nov. 21, 2000

(87) PCT Pub. No.: WO99/61957

PCT Pub. Date: Dec. 2, 1999

(51) Int. Cl.[7] ..... G03G 21/20
(52) U.S. Cl. ..... 399/93
(58) Field of Search ..... 399/115, 170, 399/171, 93; 361/225

(56) References Cited

U.S. PATENT DOCUMENTS

| | | | | |
|---|---|---|---|---|
| 3,734,015 A | | 5/1973 | Camis et al. | |
| 3,741,643 A | | 6/1973 | Vermeulen et al. | |
| 3,777,158 A | * | 12/1973 | Kamogawa et al. | 250/324 |
| 4,186,662 A | | 2/1980 | Borneman | |

(List continued on next page.)

FOREIGN PATENT DOCUMENTS

| | | | |
|---|---|---|---|
| EP | 0 274 989 A | | 7/1988 |
| EP | 0 342 704 B1 | | 11/1989 |
| WO | WO 90/04216 A1 | | 4/1990 |
| WO | WO 93/01531 A1 | | 1/1993 |
| WO | WO 93/04409 A1 | | 3/1993 |
| WO | WO 94/23347 A1 | | 10/1994 |
| WO | WO 95/10801 A1 | | 4/1995 |
| WO | WO 96/17277 A1 | | 6/1996 |
| WO | WO 97/07433 A2 | | 2/1997 |

OTHER PUBLICATIONS

Hitachi Koki Co. Ltd.; JP 03–179470 A; Aug. 5, 1991 & Patent Abstracts of Japan; vol. 015; No. 433 (P–1271); Nov. 5, 1991.

Canon Inc.; JP 53–010441 A; Jan. 30, 1978 & Patent Abstracts of Japan; vol. 002; No. 045 (E–024); Mar. 27, 1978.

Fuji Photo Film Co. Ltd.; JP 63–094287 A; Apr. 25, 1988 & Patent Abstracts of Japan; vol. 012; No. 331 (P–755); Sep. 7, 1988.

*Primary Examiner*—Quana M. Grainger
(74) *Attorney, Agent, or Firm*—Fenster & Company

(57) ABSTRACT

Duplex printing apparatus for printing on two sides of a sheet, the apparatus comprising: an impression roller on which the sheet is held during printing; an imager which prints an image on a first side of the sheet while it is being held on the impression roller; and a sheet inverter which removes the sheet from the impression roller, inverts the sheet and returns it to the impression roller for printing on a second side of the sheet by the imager, wherein the sheet is held on said impression roller referenced to a first edge thereof during the printing of the first side thereof and is also held on the impression roller referenced to said first edge during printing of the second side thereof.

22 Claims, 9 Drawing Sheets

U.S. PATENT DOCUMENTS 4,204,172 A 5/1980 Borneman
4,204,472 A 5/1980 Borneman
4,240,346 A 12/1980 Landis et al.
4,375,326 A 3/1983 Lang
4,428,667 A 1/1984 Phelps et al.
4,431,303 A 2/1984 Hoffman
4,568,169 A 2/1986 Wada et al.
4,607,940 A 8/1986 Quang
4,639,126 A 1/1987 Bushaw et al.
4,684,238 A 8/1987 Till et al.
4,745,282 A * 5/1988 Tagawa et al. ..... 250/326
4,806,079 A 2/1989 Kuhn
4,814,822 A 3/1989 Acquaviva et al.
4,884,794 A 12/1989 Dinatale et al.
4,949,949 A 8/1990 Holmes et al.
4,974,027 A 11/1990 Landa et al.
5,003,355 A 3/1991 Tanzawa
5,020,788 A 6/1991 Hatano et al.
5,023,665 A 6/1991 Gundlach
5,170,211 A 12/1992 Haupt et al.
5,552,875 A 9/1996 Sagiv et al.
5,802,424 A * 9/1998 Pernesky et al. ..... 399/92
5,837,408 A 11/1998 Parker et al.
6,072,996 A * 6/2000 Matsuo ..... 399/91

* cited by examiner

CHARGER FOR A PHOTORECEPTOR

RELATED APPLICATION

The present application is a U.S. national stage application of PCT/IL98/00235, filed May 24, 1998.

FIELD OF THE INVENTION

The present invention relates generally to printing systems and more particularly to duplex printing systems for printing variable information on one or both sides of a sheet.

BACKGROUND OF THE INVENTION

Apparatus for duplex copying of documents and for duplex printing by means of laser printers are known in the art. U.S. Pat. No. 4,949,949 to Holmes et al. describes a "Hybrid Sequencing Duplex Automatic Document Handling System" which includes apparatus for handling document sheets both sides of which are to be copied and for making duplex (i.e. to double-sided) copies of such document sheets. The apparatus involve the use of one or more pairs of reversible rollers, lengthy inversion paths, and buffer trays for the handling of the documents and the copy paper prior to and in the course of making duplex copies. U.S. Pat. No. 4,884,794 to Dinatale et al. describes a document handler for duplex photocopying having first and second inverting path segments, which are utilized to re-orient the copy paper prior to duplex copying. U.S. Pat. No. 5,003,355 to Tanzawa describes a sheet transport control apparatus for use in a duplex unit of a laser printer, the apparatus including a transport system and a switchback system, and a series of driving motors and sensors. All these systems described in the prior art share the common feature of being mechanically complex, and they all involve transporting the paper through relatively lengthy and convoluted paths after printing on the first side so as to be able to print on the second side. Other systems for duplex printing are described in U.S. Pat. Nos. 4,806,079; 4,814,822; 4,568,169; 4,639,126; 4,428,667; 4,607,940; 4,375,326 and 5,020,788 and EP publication 0342704.

PCT publication 93/04409 describes a switchback system with a much shorter path than older systems, which allowed for on demand duplex printing without storage of large numbers of sheets.

Systems which utilize the same impression roller and/or the same printing engine for printing both sides of a web are known in the art. However, even in those systems the two sides of the web are printed at different printing positions in the printer and the web is not indexed at an edge.

Also known are systems for reversing sheets between printing stations. One such system is called a "perfecta" type system and comprises a roller that acts to turn over the sheet. Such systems, unlike those used for laser printers, reference the printing sheet from the same edge for printing on both sides.

A prior art perfecta system 10 is shown in FIGS. 1A and 1B. This system comprises a first impression roller 12, which holds a sheet 14 for printing thereon by a print roller (not shown). Sheet 14 is transferred to roller 16 where it is held by a front edge clamp 20. Roller 16 continues to rotate and the front edge of sheet 14 passes an inverting roller 18. When the trailing edge reaches inverting roller 18, a clamp 20 on roller 18 catches the trailing edge of sheet 14 and, as shown in FIG. 2B inverts the sheet prior to its being clamped to a second impression roller 22.

An advantage of perfecta systems is that while the leading edge for printing the first and second sides of the sheet are reversed, the same edge is used as a reference position for printing both sides. Another advantage of perfecta systems, which is related to the first advantage, is that the sheets are always positively held by the system during inversion of the sheet. Positive holding of sheets distinguishes "perfecta" systems from systems which utilize a single printing engine and which generally do not positively hold the sheets during the entire process of transfer and reversal.

However, inverting systems which provide the advantages of perfecta systems are not known in a printer using the same impression roller and printing engine for printing both sides of the sheet.

SUMMARY OF THE INVENTION

One aspect of some preferred embodiments of the present invention provides apparatus and a method for duplex printing of sheets, utilizing the same edge of the sheet for reference for printing both sides thereof, while utilizing the same impression roller and/or the same printing engine.

One aspect of some preferred embodiments of the present invention provides apparatus and a method for duplex printing of sheets utilizing an impression roller for printing both sides of a sheet, while positively holding the sheet during the entire process of reversal and transfer of the sheet. Preferably, this means that the sheet is positively held from the start of the printing process to its end.

In a preferred embodiment of the invention, the same set of one or more printing engines is used in the printing of both sides of all the sheets.

In preferred embodiments of the present invention a perfecta-like system is used. This system includes rollers and/or belts which receive the sheet from one position on the circumference of an impression roller and, after reversing the sheet, delivers the sheet to a second position on the impression roller. Preferably, the path traveled by the sheet between the two positions holds an integral number of sheets. Preferably, the impression roller holds a plurality of sheets and presents them seriatim to one or more print engines. Preferably, the engine or engines are electrographic or other engines providing programmable images such as electrophotographic engines, ink or bubble jet print heads thermal printing heads or any other suitable printing engines.

Other aspects of some preferred embodiments of the invention are concerned with high speed printing engines, especially with high speed electrographic printing engines. In such engines special care must be taken in charging a photoreceptor and, when liquid toner is utilized, in treating and transport of the image. Some aspects of some preferred embodiments of the present invention deal with improvements in such engines especially usefully for high speed printing.

There is thus provided, in accordance with a preferred embodiment of the invention duplex printing apparatus for printing on two sides of a sheet, the apparatus comprising:

an impression roller on which the sheet is held during printing;

a imager which prints an image on a first side of the sheet while it is being held on the impression roller; and a sheet inverter which removes the sheet from the impression roller, inverts the sheet and returns it to the impression roller for printing on a second side of the sheet by the imager, wherein the sheet is held on said impression roller referenced to a first edge thereof during the printing of the first side thereof and is also held on the impression roller referenced to said first edge during printing of the second side thereof.

Preferably, the sheet inverter positively controls the position of the sheet during the inversion thereof, without releasing the sheet during the inversion.

There is further provided, in accordance with a preferred embodiment of the invention a duplex printing apparatus for printing on two sides of a sheet, the apparatus comprising:

a surface, on which an image to be printed is selectably formed;

an impression roller on which the sheet is held during printing, referenced to a first edge thereof;

a imager which prints an image on a first side of the sheet while it is being held on the impression roller; and a sheet inverter which removes the sheet from the impression roller, inverts the sheet and returns it to the impression roller for printing on a second side of the sheet by the imager, wherein the sheet inverter positively controls the position of the sheet from the removal of the sheet from the impression roller to the return of the sheet thereto after the inversion thereof, without releasing the sheet.

Preferably, the sheet inverter comprises a perfecta system.

In a preferred embodiment of the invention the sheet inverter comprises:

a paper pick-off system which removes the sheet from the impression roller, after printing of the first side of the sheet, while the sheet is held referenced to said first edge;

an inverting transport past which the first edge is carried while the sheet remains referenced to said first edge; and a sheet pick-off on said inverting transport which captures a second edge of the sheet, opposite the first edge while the sheet is still being held referenced to the first edge, such that said capture is made referenced to the first edge, said inverting transport transporting the second edge to the impression roller for capture by the impression roller, such that the second side of the sheet is presented for printing by the imager.

Preferably the apparatus includes at least one intermediate transport which receives the sheet from the paper pick-off system and transports it to the inverting transport while the sheet remains referenced to the first edge. Preferably, the at least one intermediate transport comprises at least one roller.

Preferably, the inverting transport comprises a transport roller.

In a preferred embodiment of the invention the a sheet path in the paper pick-off, sheet pick-off and intermediate transport is at least the length of a plurality of sheets.

Preferably, the imager comprises a plurality of imaging stations each of which transfers an image of a different color to the sheet.

Preferably, the imager includes an image forming surface on which the image is formed prior to transfer to the sheet. Preferably, the imager includes at least one intermediate transfer member to which images are transferred from the image forming surface and from which the images are transferred to the sheet.

In a preferred embodiment of the invention, the imager provides different images to the sides of the sheet.

According to one preferred embodiment of the invention the imager is an electrographic imager.

The imager can be a powder toner imager or a liquid toner imager.

The imager can be an inkjet or bubble jet imager.

In a preferred embodiment of the invention the impression roller is adapted to hold a plurality of sheets at one time.

There is further provided, in accordance with a preferred embodiment of the invention a charger for a photoreceptor comprising:

at least one electrified charging surface adjacent the photoreceptor;

a source of gas which flows the gas past the charging surface toward the surface of the photoreceptor; and at least one gas outlet adjacent the photoreceptor and the at least one charging surface, through which air is drawn from the surface of the photoreceptor, such that ionized air produced by the charging surface is substantially removed from the photoreceptor surface without being released to the surroundings.

Preferably the charger comprises a plurality of charging wires. Preferably the charging wires are arranged in pairs to form at least one double charger.

In a preferred embodiment of the invention the charger includes a pair of gas outlets situated on either side of the at least one charging surface.

There is further provided, in accordance with a preferred embodiment of the invention apparatus from removing excess liquid from a surface containing a liquid toner image comprising:

a source of gas which flows gas onto the surface; and a chamber, adjacent the source and the surface, which receives a mixture of air and liquid, carried by the air and removes the mixture from the surface without contaminating the surroundings.

Preferably the source of gas comprises an outlet from which the gas flows to the surface, wherein the chamber comprises at least one inlet for receiving the mixture of gas and liquid.

Preferably, the inlet receives said mixture from the surface on both an upstream and a downstream side of the outlet.

Preferably the chamber removes the mixture by suction.

Preferably the source of gas comprises an air knife that directs gas along the surface.

In one preferred embodiment of the invention, the surface has a liquid image thereon that is acted upon by the apparatus.

There is further provided, in accordance with a preferred embodiment of the invention, a duplex printing method for printing on two sides of a sheet, the method comprising:

printing an image on a first side of the sheet at a printing position, the sheet and thus said printing being referenced to an edge of the sheet;

inverting the sheet and returning it to the printing position while it remains referenced to said edge; and printing an image on a second side of the sheet at said printing position while the sheet and thus said printing is referenced to said edge.

Preferably, the position of the sheet is positively controlled during inversion thereof, without releasing the sheet between printing of the first and second sides thereof.

There is further provided, in accordance with a preferred embodiment of the invention a duplex printing method for printing on two sides of a sheet, the method comprising:

printing an image on a first side of the sheet at a printing position;

inverting the sheet and returning it to the printing position; and printing an image on a second side of the sheet at said printing position, wherein the position of the sheet is positively controlled during printing and inversion thereof, without releasing the sheet.

Preferably, the sheet is delivered to said printing position by a moving member on which it is held while being referenced to said edge.

In a preferred embodiment of the invention the sheet is printed while being moved by the moving surface, past the printing position and wherein the sheet is held at said edge during printing of one side thereof and held by an opposite edge of the sheet during printing of the other side thereof.

Preferably, the sheet is printed while being moved past the printing position with said edge passing the position first during printing of one side of the sheet and wherein said edge passes the printing position after the rest of the sheet during the printing of the other side of the sheet.

Preferably the method includes printing different images on the two sides of the sheet.

BRIEF DESCRIPTION OF THE DRAWINGS

The present invention will be more completely understood and appreciated from the following detailed description of preferred embodiments of the invention, taken in conjunction with the drawings in which.

DETAILED DESCRIPTION OF PREFERRED EMBODIMENT

Figure 2:
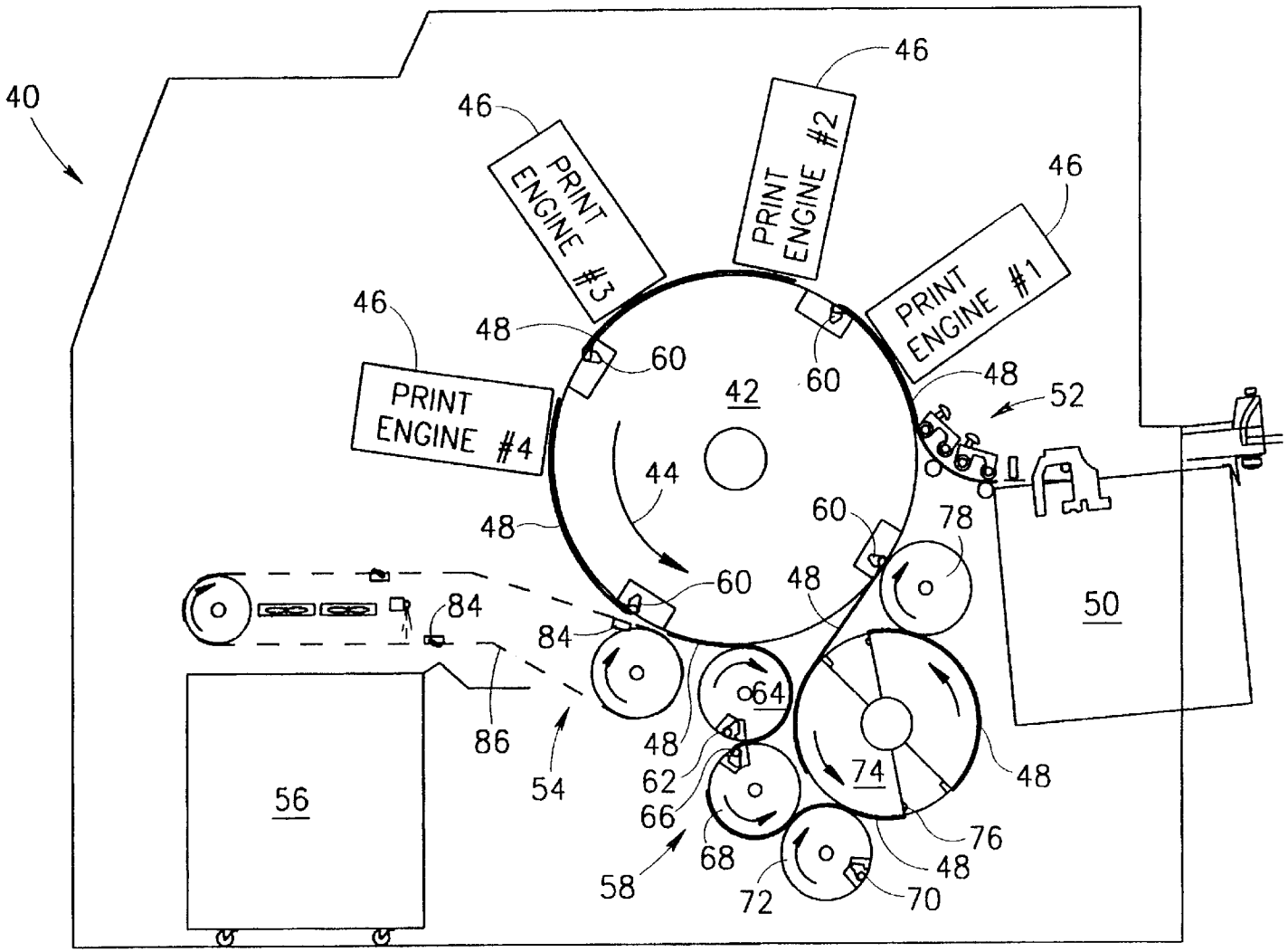
FIG. 2 is a schematic cross-sectional view of a single impression roller duplex printing apparatus in accordance with a preferred embodiment of the invention.
Figure 3:
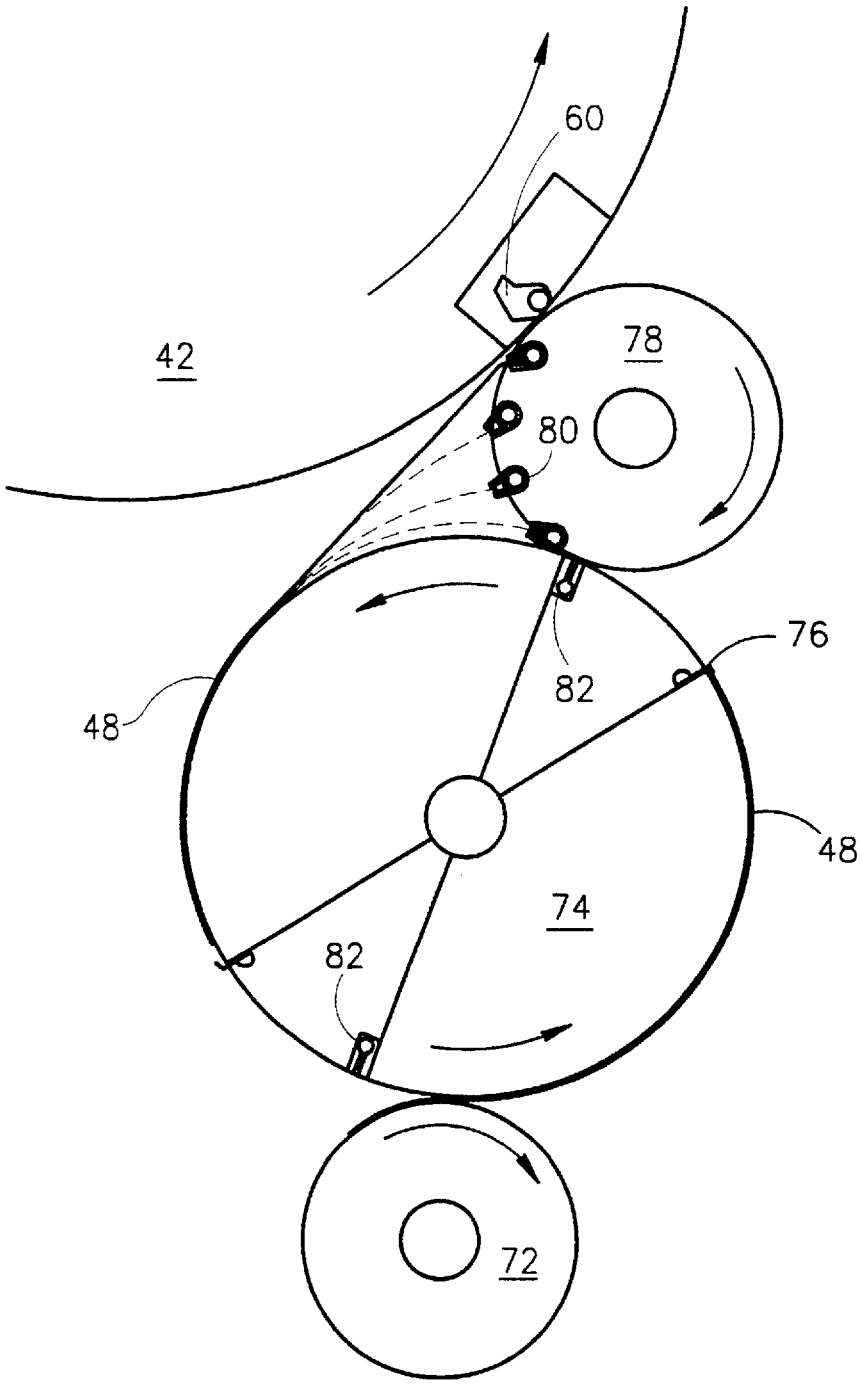
FIG. 3 is a schematic cross sectional view of a portion of the apparatus of FIG. 2, showing a portion the mechanism by which a sheet is inverted.

Reference is now made to FIGS. 2 and 3, which illustrate a multi-color duplex printing system 40 in accordance with a preferred embodiment of the present invention.

System 40 includes an impression roller 42 that rotates in a direction indicated by arrow 44. Situated around the periphery of roller 42 are one or more print engines 46. In a preferred embodiment of the intention, each of engines 46 transfers a single color image to substrate sheets 48 that are held on- and travel with- impression roller 42. Thus, as illustrated in FIG. 2, four color separations may be printed on a sheet as it sequentially passes the four engines shown. If it is desired to print a greater or lesser number of colors, more or fewer engines may be provided. While in a preferred embodiment of the invention engines 46 are a particular type of electrophotographic engine described below, any suitable electrophotographic engine or a printing engine of another type may be used. Especially suitable for use in the present invention are printing engines which print a variable image, such as a computer generated image. This allows for different images to be printed on the front and back of the sheet and for different images to be printed on sequential sheets.

Also situated around the periphery of impression roller 42 are a source of sheets 50 and associated sheet feeding apparatus 52, a sheet take-off apparatus 54, a stacker for printed sheets 56 and a sheet inverting system 58. A portion of inverting system 58, illustrating various stages in the inversion of a sheet, is shown in FIG. 3.

Figure 1A:
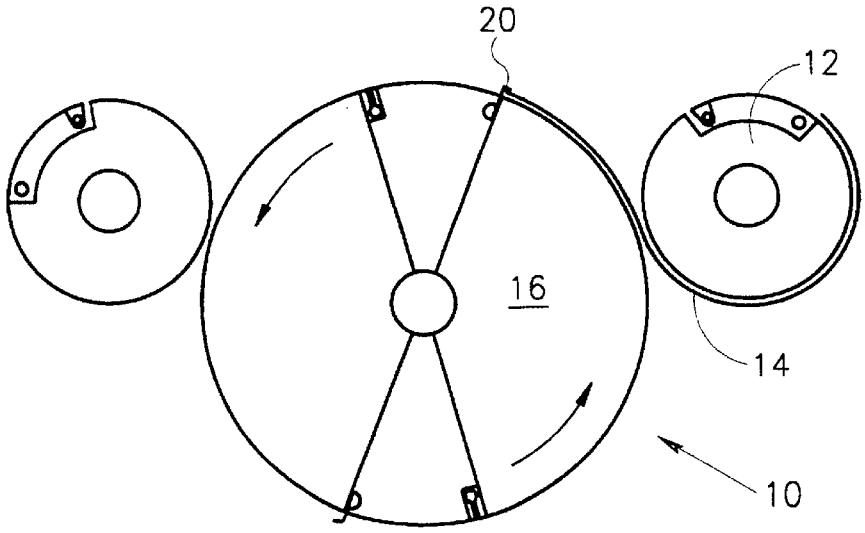
FIG. 1A PRIOR ART
FIGS. 1A and 1B illustrate schematically a prior art multi-station (multi-impression roller) duplex printing apparatus.
Figure 1B:
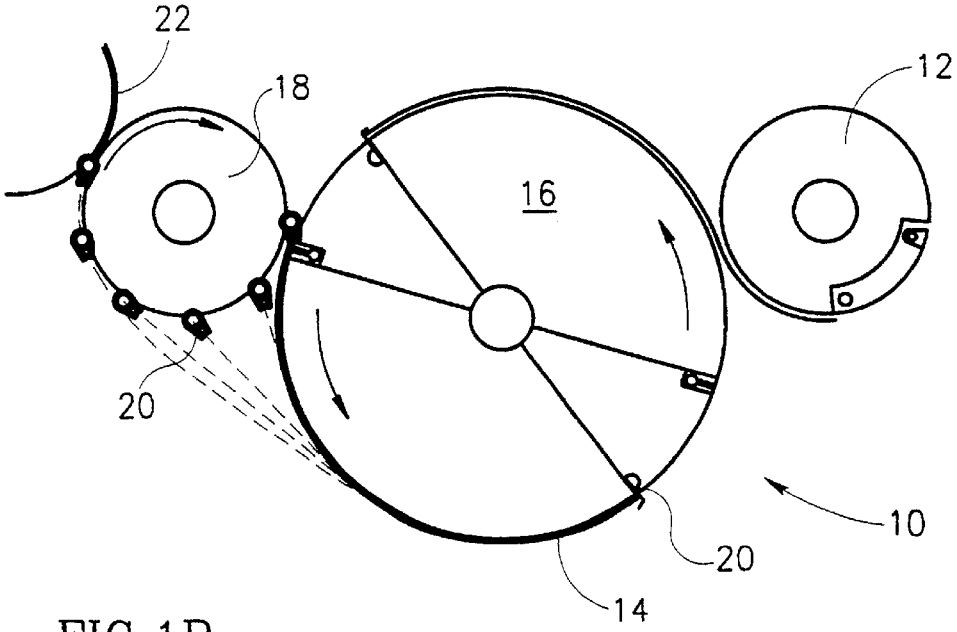
FIG. 1B PRIOR ART

The following discussion describes the progress of a single sheet 48 as it is printed on both sides. As shown in FIG. 1, one edge of each of sheets 48 is held by a clamp 60 of conventional design. A sheet 48 is synchronously fed from source 50, by feeding apparatus 52 such that its leading edge is captured by one of clamps 60. Impression roller 42, which is preferably driven by a motor (not shown) carries sheet 48 past print engines 46 such that by the time it passes the last engine, printing of a first side of the sheet is complete. Alternatively, fewer engines may be used and each engine may print a plurality of colors in one of several rotations of impression roller 42. The sheet then approaches sheet take-off mechanism 54. Since only the first side of sheet 48 has been printed, mechanism 54 is not activated and sheet 48 passes it. A controller (not shown), which controls the printing and sheet transportation determines which path the sheet should take. As the leading edge of the sheet held by clamp 60 passes a first roller 64 of inverting system 58, the leading edge of sheet 48 is handed off to a similar clamp 62 on roller 64. The leading edge of the sheet is then successively handed off to a clamp 66 on a roller 68 and a clamp 70 on a roller 72. During each hand-off the sheet is held between two rollers and or by a clamp such that registration of the leading edge is preserved.

When the leading edge of the sheet approaches a roller 74, the leading edge is captured to by a clamp 76 and carried toward roller 74. Roller 74 receives the sheet and a clamp 76 holds the sheet on the roller.

When the leading edge of sheet 48 reaches an inverting roller 78, the trailing edge is fed to a clamp 80 on roller 78 (shown more clearly in FIG. 3.) preferably utilizing by a lifter 82. Lifter 82 may lift the trailing edge of the sheet by air pressure or mechanically. Lifter 82 can also utilize a vacuum to hold the sheet to the roller. It should be understood that when clamp 80 captures the trailing edge of sheet 48, the position of the sheet is still determined by its leading edge, held by clamp 76. Clamp 76 releases sheet 48 as or just after it is captured by clamp 80.

However, while sheet 48 has reversed direction (as well as having been turned over), and is traveling with the (former) trailing edge first, its position remains referenced to the leading edge, which reference has been preserved during the various hand-offs of the sheet from roller to roller.

FIG. 3 shows a number of stages of transfer of sheet 48 from roller 74 to impression roller 42 by roller 78 and clamp 80. As can be seen from FIG. 3, the sheet has now been reversed and, when it is transferred to impression roller 42 it is ready for having its second side printed.

Returning again to FIG. 2, sheet 48 again passes printing engines 46 whereat an image is printed on the second side of the sheet.

The sheet now approaches take-off apparatus 54. Since both sides of the sheet have now been printed, the sheet is ready for removal. As clamp 60 (holding the edge of the sheet) approaches apparatus 54, a clamp 84 on a belt 86 receives the sheet and removes it to stacker 56.

When the blank space in the inverter system reaches the impression roller another sheet is fed to impression roller 42 from source 50 and placed in the position vacated by the sheet which was removed by apparatus 54. It should be understood that whenever no sheet is available from inverter 58 to fill a clamp 60, a new sheet is preferably fed from paper source 50.

While the system has been shown with an inverter having a path that holds three sheets at one time and an impression roller that has four sections for holding sheets, a greater or lesser number of sheets and positions can be provided. One major consideration is the amount of room taken by the print engines and other apparatus situated around the periphery of the impression roller. Furthermore, while separate engines for each color are shown, a single multicolor engine may be provided. Furthermore, stacker 56 may be replaced by a finisher which produces booklets directly from the sheets as they are printed.

Figure 4:
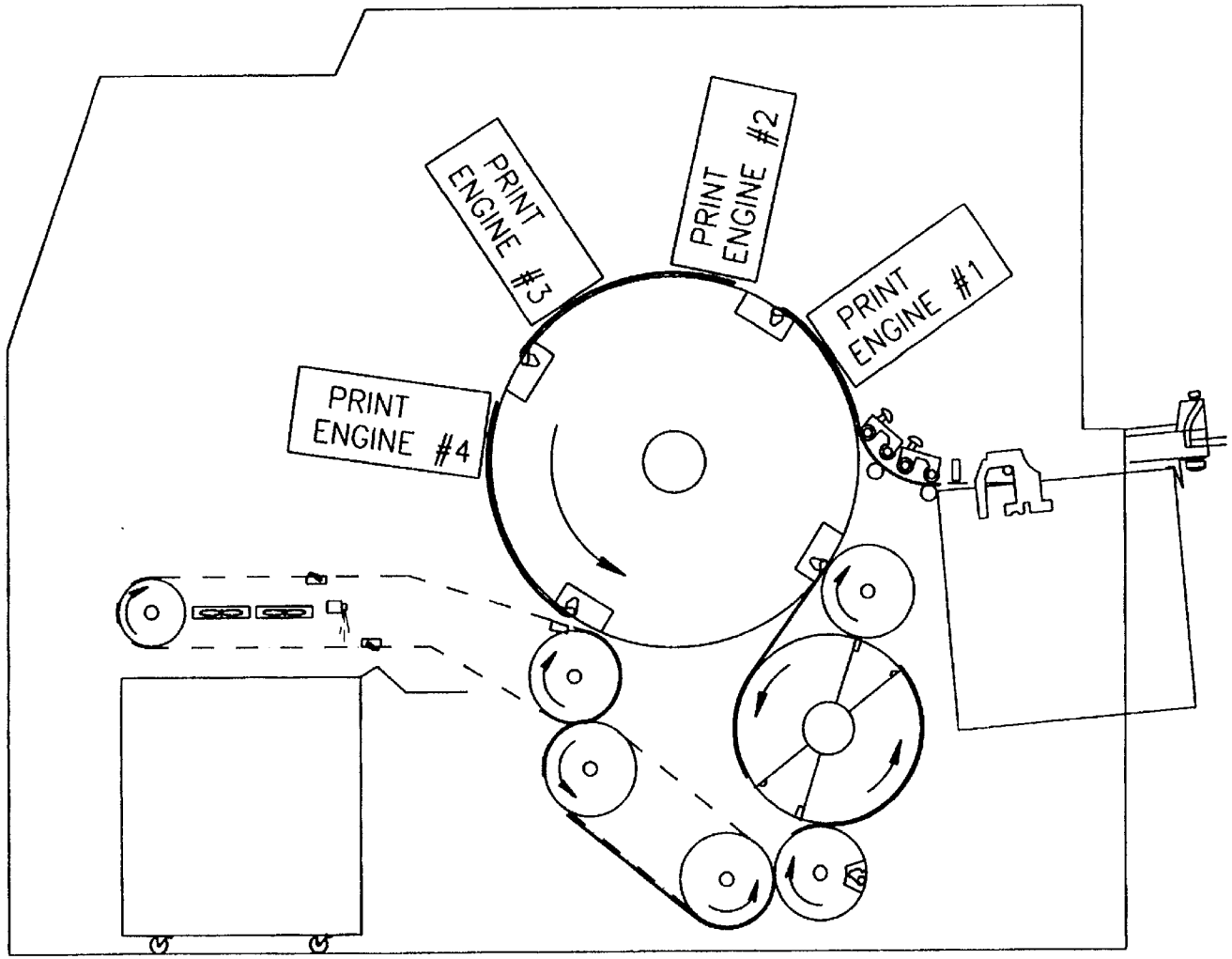
FIG. 4 is a schematic cross sectional view of an alternative apparatus for inverting a sheet in accordance with a preferred embodiment of the invention.

FIG. 4 shows an alternate inverting system in which rollers 64 and 68 have been replaced by a belt mechanism which receives the sheets from the front end of take-off apparatus 54.

Figure 5:
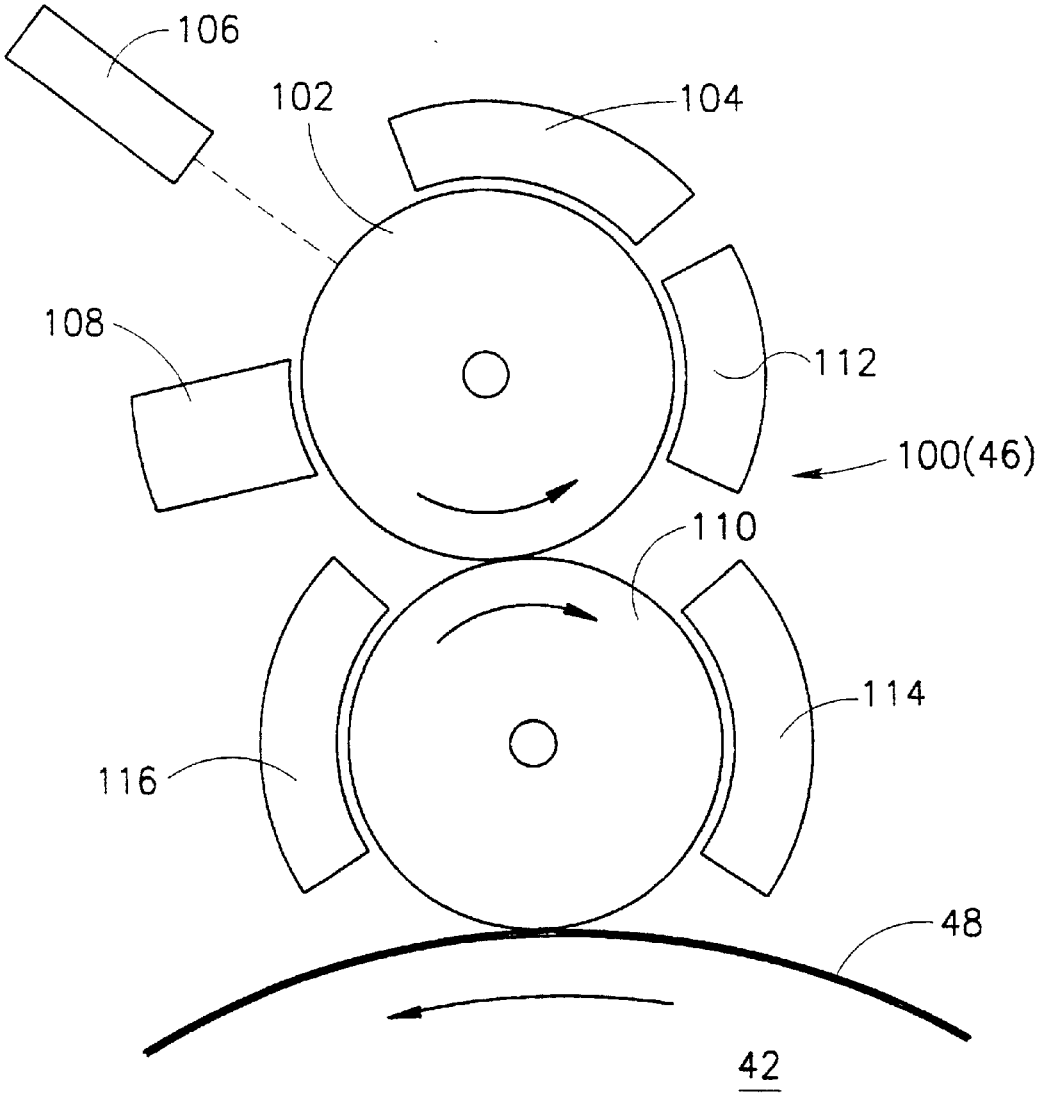
FIG. 5 is a very schematic cross-sectional illustration of a printing engine in accordance with a preferred embodiment of the invention.

FIG. 5 shows a very schematic representation of a preferred printing engine 100 (corresponding to one of engines 46 of FIG. 2), in accordance with a preferred embodiment of the invention. While preferred engine 100 is especially suitable for a high speed duplexing system as shown in FIGS. 2–4, as indicated above, the duplexing system can operate with a wide variety of print engines. Similarly, engine 100 may operate with other types of duplexing systems or in a single sided printer.

Engine 100 includes a photoreceptor drum 102, a charger 104 which charges the photoreceptor, an imagewise discharge system, such as a scanning laser 106 which forms a latent image on charged drum 102 and a developer 108 which develops the latent image. The developed image is preferably transferred to an intermediate transfer member 10. After the image is transferred to intermediate transfer member 110, photoreceptor 102 is cleaned of residual toner by a cleaning station 112.

For slow speed systems, intermediate transfer members as described below can operate without any drying systems. In these systems the heat of the intermediate transfer member dries the image somewhat and removes some of the liquid carrier in the image, to improve the transfer of the image to sheet 48 on impression roller 42. For some systems, liquid is removed prior to transfer of the image to the intermediate transfer member. For high speed imaging a dryer 114 is preferably used to dry the image on the intermediate transfer member. After transfer of the image to sheet 48, a further dryer 116 removes some liquid which remains on or is solvated by the intermediate transfer member to improve transfer of the next image to the intermediate transfer member.

The elements of engine 100 may be purely conventional as has been described in numerous patents, patent applications and patent publications assigned to the assignee of the present application, Indigo, N.V. and Spectrum Sciences B.V. In addition certain parts of the preferred embodiment of the invention including intermediate transfer blankets, photoreceptor sheets, etc. are available from Indigo, N.V.

Some of such elements are described, for example, in PCT publications WO 94/23347, WO 96/17277, WO 97/07433, in U.S. Pat. No. 4,684,238, PCT Publication WO 90/04216, U.S. Pat. No. 4,974,027 and WO 93/01531 and in other patents and applications referred to therein. The disclosures of all these documents are incorporated here by reference.

Figure 6:
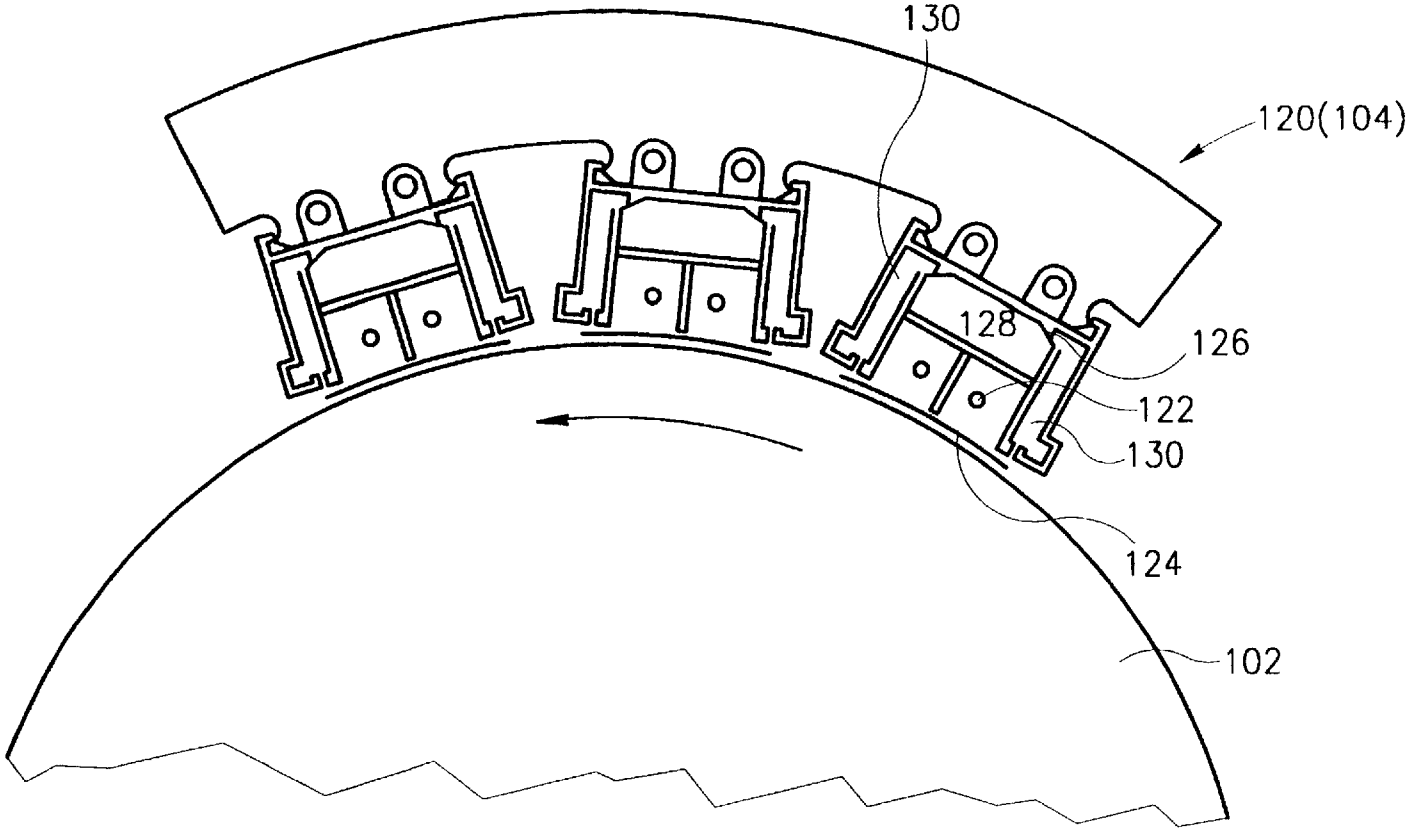
FIG. 6 illustrates a photoreceptor charging system, especially suitable for high speed printing, in accordance with a preferred embodiment of the invention.

FIG. 6 shows a preferred embodiment of a charger 120 corresponding to charger 104 of FIG. 5. The charger shown comprises six corotrons or scorotrons, each comprising a charging surface such as a charged wire 122 and grid 124 for scorotrons, although a greater or lesser number may be used as required. Each pair of scorotrons is preferably housed in a housing 126 including a chamber 128 into which air is pumped. This air is forced by pressure past wires 122 and onto the surface of photoreceptor 120. This flow of air carries away evaporated carrier liquid which otherwise has a tendency to coat the wires and reduce their life. In addition, this flow also caries away ozone which is generated by the charging surface.

In order to prevent the air (now containing some carrier liquid and/or ozone) from contaminating the surroundings, both inside the printer and outside of it, chambers 130 are provided, beside the scorotrons. These chambers are connected to suction pumps, such that air fed to chambers 128 and passing wires 122 to the surface of drum 102 is immediately removed from the environment. In a preferred embodiment of the invention, carrier liquid and/or ozone are removed from the air suctioned via chambers 130, for example by catalytic action.

Figure 7:
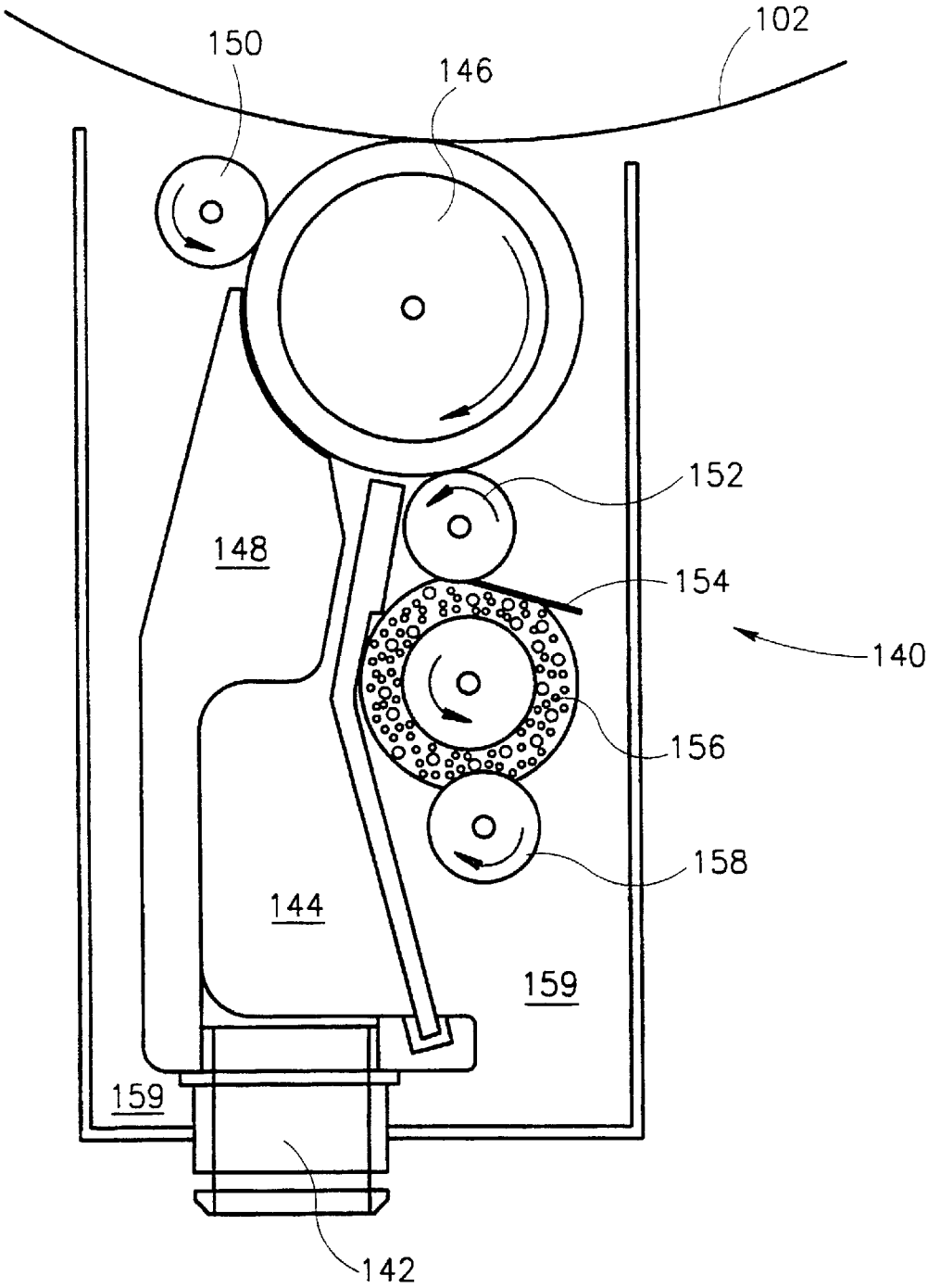
FIG. 7 illustrates a developing station in accordance with a preferred embodiment of the invention.

FIG. 7 shows a preferred embodiment of a developer 140 corresponding to developer 108 of FIG. 5. This developer corresponds generally to developers whose structure and operation is shown and described in WO 93/01531 and WO 95/10801, the disclosures of which are incorporated herein by reference. Developer 108 comprises a toner inlet 142 which feeds toner concentrate to a toner chamber 144. Toner is fed from chamber 144 to a rotating developer roller 146. The rotation of developer roller 146 pumps the toner past an electrode 148. A voltage difference between electrode 148 and roller 146 preferably coats roller 146 with a concentrated layer of toner. A squeegee 150 preferably removes additional liquid from the toner layer which layer is then selectively transferred to develop a latent image on photoreceptor 102. Toner remaining on developer 146 is preferably removed by a charged roller 152 (see for example element 174 in FIG. 7B of WO 93/01531). Toner is preferably removed from roller 152 by the combined action of a scrapper 154 and a counter rotating sponge roller 156. A squeegee 158 preferably compresses sponge roller 156 and removes excess material from it into a waste chamber 159. Other designs of liquid development systems or powder toner systems may be substituted for developer 140 if desired.

Figure 8:
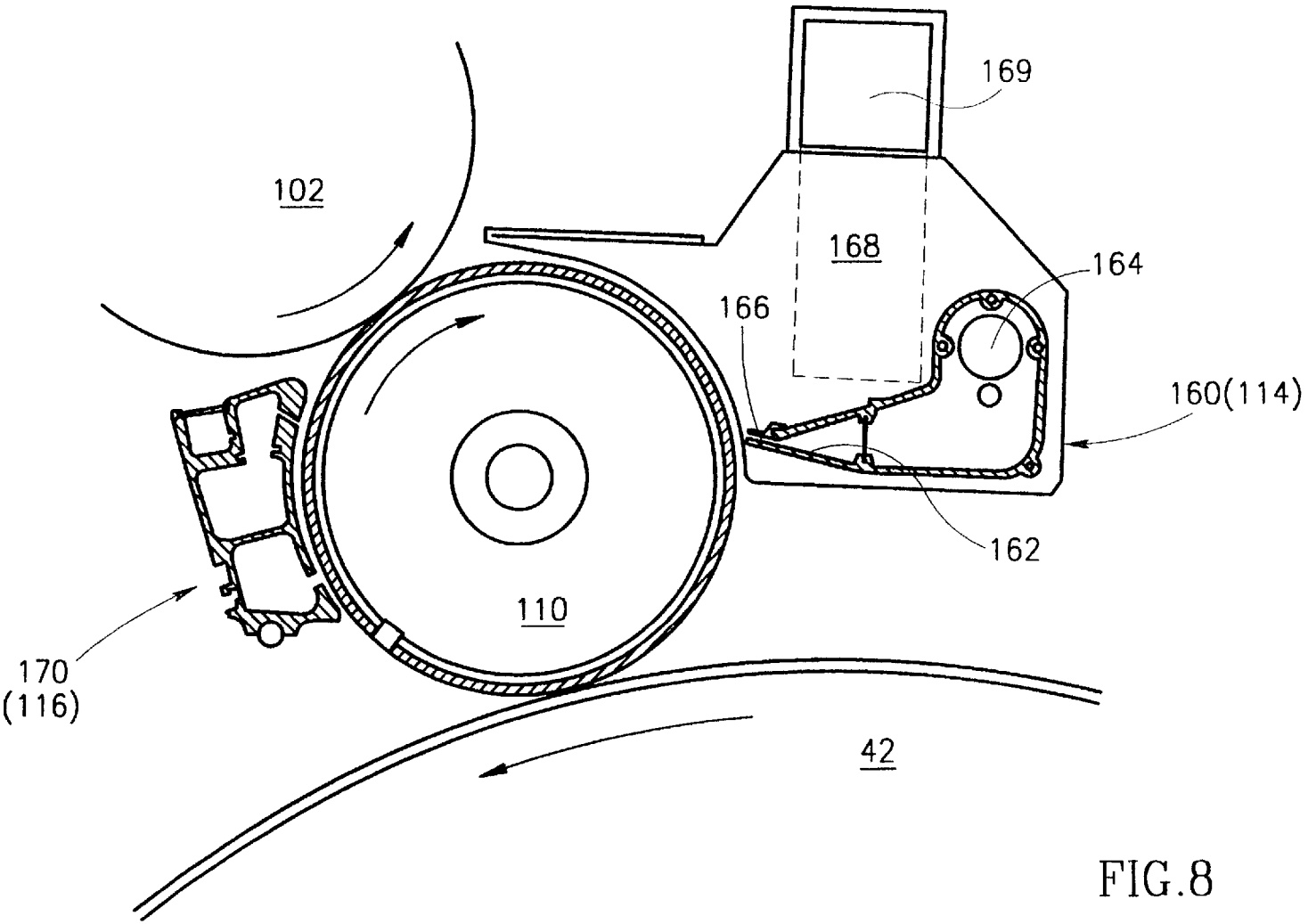
FIG. 8 illustrates an intermediate transfer member and associated apparatus, in accordance with a preferred embodiment of the invention.

FIG. 8 shows further details of print engine 100. In preferred embodiments of the invention, especially where the printing speed is high, it is desirable to dry the image somewhat while heating it on intermediate transfer member 110. To this end, a dryer 160 (corresponding to dryer 114 of FIG. 5) is preferably provided. To minimize the amount of pollution generated, dryer 160 preferably comprises a chamber 162 into which air is pumped via an inlet 164. The air exits chamber 162 via an exit slit 166 onto the surface of transfer member 110. The air which exits slit 166 preferably forms an air knife. A second chamber 168, open to the surface of the transfer member, is provided with an exit for air through which air is withdrawn via an exit port 169. Thus, excess carrier liquid that is withdrawn from the image on intermediate transfer member 110 is immediately removed without polluting the internal environment of the printer.

To improve transfer of images and to provide more consistent transfer, intermediate transfer member 110 is preferably provided with a further dryer 170 (corresponding to dryer 116 of FIG. 5), which driver operates in a similar manner to dryer 160, in that air is forced onto the surface of the intermediate transfer member and is removed therefrom by suction.

In preferred embodiments of the invention, carrier liquid removed by dryers 160 and 170 is removed from the air stream, for example by catalytic action and the air is recirculated for drying.

Figure 9:
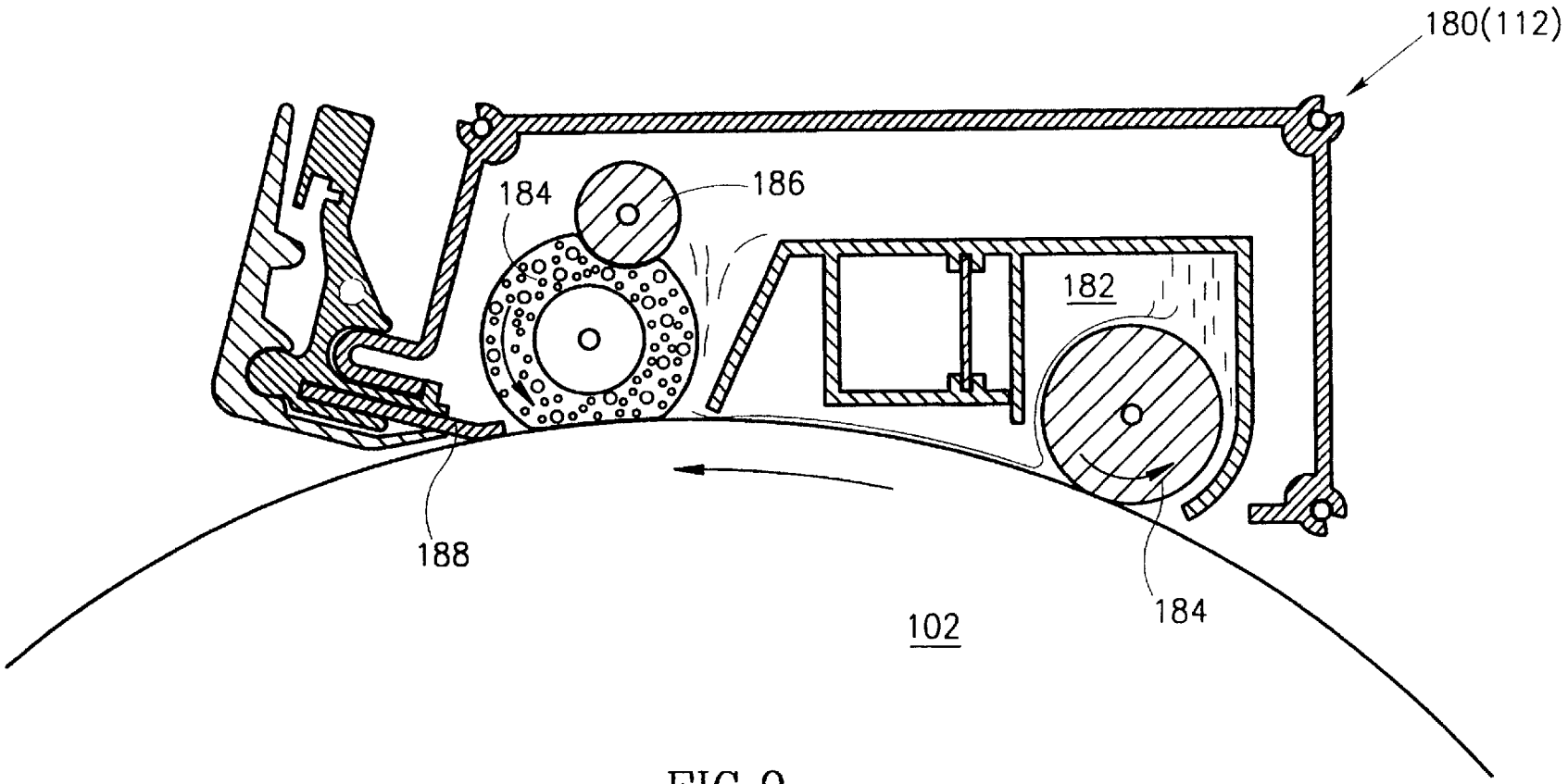
FIG. 9 is a cross-sectional representation of a clearing station in accordance with a preferred embodiment of the invention.

FIG. 9 shows a cleaning station 180 corresponding to cleaning station 112 of FIG. 5. Cleaning station 180 comprises three stages In a first stage cooled liquid (for example carrier liquid) is supplied to the surface via a chamber 182. A roller 184 is operative to keep the liquid from leaking out of the cleaner and for pumping it in the upstream direction of photoreceptor 102. The cooled liquid flows along the surface of the photoreceptor to a counter-rotating sponge roller 184 which removes adhering toner particles. These particles and liquid picked up by the sponge roller are squeegeed out of sponge roller 184 by a squeegee roller 186. A scrapper blade 188 completes the cleaning process by scrapping any remaining toner from the surface and keeping excess carrier liquid from leaving the cleaning station.

While a preferred printing engine has been shown and described, it should be understood that duplex printers of the type described above may use other types of electrographic printers as are known in the art. Thus, the printing engines may be of any suitable type. Preferably, the engines are of a type which produces images under control of a computer such that the images may be changed from print to print. Such printers are generally known as "digital" printing engines. Furthermore, while in the preferred embodiment of the invention, image transfer utilizing an intermediate transfer member is described, such transfer may be replaced by direct transfer from an imaging surface.

While the present invention has been described with respect to preferred embodiments thereof, these embodiments are presented by way of example only and are not meant to limit the scope of the invention which is defined by the claims. Furthermore, embodiments of the invention may incorporate some but not all features of the above preferred embodiments and may include combinations of features from different embodiments.

We claim:

1. A charger for a photoreceptor comprising:

at east one electrified charging surface adjacent the photoreceptor;

a source of gas which flows the gas past the charging surface toward the surface of the photoreceptor; and at least one gas outlet adjacent the photoreceptor, through which gas is drawn from the surface of the photoreceptor, such that ionized gas produced by the charging surface is substantially removed from the photoreceptor surface without being released to the surroundings.

2. A charger according to claim 1 wherein the charger comprises a plurality of charging wires.

3. A charger according to claim 2 wherein the charging wires are arranged in pairs to form at least one double charger.

4. A charger according to claim 3 wherein the charger comprises:

a housing within which the at least one charging surface is situated, said housing having an edge spaced from the photoreceptor surface, such that said gas escapes from said housing via a space between the housing and the photoreceptor;

wherein said at least one gas outlet draws gas from said photoreceptor surface after is escapes from said housing.

5. A charger according to claim 4 wherein said at least one gas outlet comprises a pair of gas outlets situated on either side of the at least one charging surface.

6. A charger according to claim 5 wherein the at least one gas outlet draws said ionized gas directly from the surface and not via said charging members.

7. A charger according to claim 3 wherein said at least one gas outlet comprises a pair of gas outlets situated on either side of the at least one charging surface.

8. A charger according to claim 7 wherein the at least one gas outlet draws said ionized gas directly from the surface and not via said charging members.

9. A charger according to claim 3 wherein the at least one gas outlet draws said ionized gas directly from the surface and not via said charging members.

10. A charger according to claim 2 wherein the charger comprises:

a housing within which the at least one charging surface is situated, said housing having an edge spaced from the photoreceptor surface, such that said gas escapes from said housing via a space between the housing and the photoreceptor;

wherein said at least one gas outlet draws gas from said photoreceptor surface after is escapes from said housing.

11. A charger according to claim 10 wherein said at least one gas outlet comprises a pair of gas outlets situated on either side of the at least one charging surface.

12. A charger according to claim 11 wherein the at least one gas outlet draws said ionized gas directly from the surface and not via said charging members.

13. A charger according to claim 2 wherein said at least one gas outlet comprises a pair of gas outlets situated on either side of the at least one charging surface.

14. A charger according to claim 13 wherein the at least one gas outlet draws said ionized gas directly from the surface and not via said charging members.

15. A charger according to claim 2 wherein the at least one gas outlet draws said ionized gas directly from the surface and not via said charging members.

16. A charger according to claim 1 where the charger comprises;

a housing within which the at least one charging surface is situated, said housing having an edge spaced from said photoreceptor surface, such that said gas escapes from said housing via a space between the housing and the photoreceptor, wherein said at least one gas outlet draws said gas from said photoreceptor surface after it escapes from said housing.

17. A charger according to claim 16 wherein said at least one gas outlet comprises a pair of gas outlets situated on either side of the at least one charging surface.

18. A charger according to claim 17 wherein the at least one gas outlet draws said ionized gas directly from the surface and not via said charging members.

19. A charger according to claim 16 wherein the at least one gas outlet draws said ionized gas directly from the surface and not via said charging members.

20. A charger according to claim 1 wherein said at least one gas outlet comprises a pair of gas outlets situated on either side of the at least one charging surface.

21. A charger according to claim 20 wherein the at least one gas outlet draws said ionized gas directly from the surface and not via said charging members.

22. A charger for a photoreceptor comprising:

at least one electrified charging surface adjacent the photoreceptor;

a source of gas which flows the gas past the charging surface toward the surface of the photoreceptor; and at least one gas outlet adjacent the photoreceptor and the at least one charging surface, through which air is drawn from the surface of the photoreceptor, such that ionized air produced by the charging surface is substantially removed from the photoreceptor surface without being released to the surroundings, wherein the at least one gas outlet draws said ionized gas directly from said surface and not via said charging members.

* * * * *

UNITED STATES PATENT AND TRADEMARK OFFICE

CERTIFICATE OF CORRECTION

PATENT NO. : 6,608,979 B1
APPLICATION NO. : 09/700986
DATED : August 19, 2003
INVENTOR(S) : Benzion Landa et al.

It is certified that error appears in the above-identified patent and that said Letters Patent is hereby corrected as shown below:

Title page, item (56) References Cited, FOREIGN PATENT DOCUMENTS, add --WO 97/07433 A3 2/1997--
Title page (second page), item (56) References Cited, U.S. PATENT DOCUMENTS, line 1, remove "4,204,172"
Claim 1, line 2, change "east" to --least--

Signed and Sealed this

Eighth Day of May, 2007

JON W. DUDAS
*Director of the United States Patent and Trademark Office*